US007111592B1

(12) United States Patent
Kern et al.

(10) Patent No.: US 7,111,592 B1
(45) Date of Patent: Sep. 26, 2006

(54) APPARATUS AND METHOD FOR COOLING ENGINE COOLANT FLOWING THROUGH A RADIATOR

(75) Inventors: Robert D. Kern, Waukesha, WI (US); Bret Baird, North Prairie, WI (US); Allen D. Gillette, Muskego, WI (US); Michael J. Roll, West Bend, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 0 days.

(21) Appl. No.: 11/070,531

(22) Filed: Mar. 2, 2005

(51) Int. Cl.
*F01P 7/12* (2006.01)

(52) U.S. Cl. ..... 123/41.12; 123/41.49; 123/41.65; 165/51; 290/1 B

(58) Field of Classification Search ..... 123/41.12, 123/41.11, 41.49, 41.65; 290/1 B; 165/DIG. 228, 165/51, 121, 122; 180/68.1

See application file for complete search history.

(56) References Cited

U.S. PATENT DOCUMENTS 2,807,246 A * 9/1957 Jacobs ..... 123/41.12
2,903,083 A * 9/1959 Kelley ..... 123/41.12

* cited by examiner

*Primary Examiner*—Tony M. Argenbright
*Assistant Examiner*—Katrina Harris
(74) *Attorney, Agent, or Firm*—Boyle Fredrickson Newholm Stein & Gratz S.C.

(57) ABSTRACT

An apparatus and method are provided for facilitating the cooling of engine coolant flowing through a radiator operatively connected to the engine of an engine-driven, electrical generator set. The engine has a crankshaft rotatable about a first axis and a radiator having a first side directed towards the engine and a second side. The apparatus includes a fan positionable on the second side of the radiator that is rotatable about a second axis generally parallel to and vertically spaced from the first axis. The apparatus includes a thermally responsive clutch having a driven portion. The clutch is movable between a first disengaged position wherein the driven portion is isolated from the crankshaft and a second engaged position wherein the driven portion rotates in unison with the crankshaft in response to a predetermined temperature. A fan drive system interconnects the driven portion of the clutch and the fan for translating rotation of the driven portion to the fan.

17 Claims, 2 Drawing Sheets

APPARATUS AND METHOD FOR COOLING ENGINE COOLANT FLOWING THROUGH A RADIATOR

FIELD OF THE INVENTION

This invention relates generally to engine-driven, electrical generators, and in particular, to an apparatus and method for cooling the engine coolant flowing through a radiator of an engine-driven, electrical generator.

BACKGROUND AND SUMMARY OF THE INVENTION

Engine-driven, electrical generators are used in a wide variety of applications. Typically, such electrical generators utilize a single driving engine directly coupled to a generator or alternator through a common shaft. Upon actuation of the engine, the crankshaft thereof rotates the common shaft so as to drive the alternator which, in turn, generates electricity. It can be appreciated that since the engine and the alternator are housed in a single enclosure, a significant amount of heat is generated within the enclosure during operation of the electrical generator.

Typically, prior electrical generators include radiators operatively connected to corresponding engines such that the engine coolant from the engines circulates through the radiators during operation of the engines. A fan, coupled to the crankshaft of the engine, rotates during operation of the electrical generator and draws air across the plurality of radiator tubes of the radiator so as to effectuate the heat exchange between the engine coolant flowing through the plurality of radiator tubes of the radiator and the air within the enclosure. In such a manner, it is intended that the air passing over the radiator tubes of the radiator having a cooling effect thereon so as to maintain the temperature of the engine coolant, and hence the temperature of the engine, below a safe operating limit.

As is known, operation of an engine driven, electrical generator can produce unwanted noise. The noise generated by the electrical generator during operation is often a result of the rotation of the fan used to cool the engine coolant flowing through the radiator tubes of the radiator of the electrical generator. Consequently, various attempts have been made to limit the time period and the speed at which the fan rotates during operation of the electrical generator to those situations wherein the engine coolant flowing through the radiator must be cooled. By way of example, a sensor may be provided to monitor the temperature of the engine coolant. The fan is operatively connected to the crankshaft of the engine only when the temperature of the engine coolant exceeds a predetermined threshold. Alternatively, in automotive applications, the fan may be connected to the crankshaft by a thermally responsive clutch. The clutch directly connects the fan to the crankshaft of the engine when the air drawn through the radiator by the fan exceeds a predetermined temperature threshold.

While these prior methods of minimizing the time period for rotating a fan of an engine-driven, electrical generator have been somewhat successful, each of these methods has significant limitations. By way of example, the use of a sensor and the associated electronics for selectively connecting the fan to the crankshaft of the engine can be cost prohibitive. Alternatively, by drawing air inward through the radiator as provided in various automotive applications, it has been found that the thermally responsive clutch interconnects the fan to the crankshaft at the engine for a longer period of time than is necessary to cool the engine coolant flowing through the radiator to a safe operating level. Hence, it can be appreciated that these prior art fan systems will generate more noise than necessary and/or desired by an end user.

Therefore, it is a primary object and feature of the present invention to provide a method and apparatus for reducing the fan noise associated with the operation of an engine driven, electrical generator.

It is a further object and feature of the present invention to provide a method and apparatus for reducing the fan noise associated with the operation of an engine driven, electrical generator that is simple and inexpensive to implement.

It is a still further object and feature of the present invention to provide a method and apparatus for reducing the fan noise associated with the operation of an engine driven, electrical generator that sufficiently cools the engine coolant flowing through the radiator of the electrical generator with the fan.

It is a still further object and feature of the present invention to provide a method and apparatus for sufficiently cooling the engine coolant flowing through the radiator of an engine for an engine-driven, electrical generator set that is adaptable for use with engines of different sizes.

In accordance with the present invention, a fan assembly is provided. The fan assembly is connectable to the crankshaft of an engine for facilitating the cooling of engine coolant flowing through a radiator. The radiator has a first side directed toward the engine and a second side. The fan assembly includes a rotatable fan positionable on the second side of the radiator. A driven pulley is operatively connected to the fan for rotational movement therewith. The fan assembly further includes a rotatable drive pulley and a fan belt system extending about the drive pulley and the driven pulley. The fan belt system translates rotation of the drive pulley to the fan. A fan clutch is also provided. The fan clutch is movable between a first disengaged position wherein the drive pulley is isolated from the crankshaft and a second engaged position wherein the fan clutch translates rotation of the crankshaft to the drive pulley in response to a predetermined temperature. The fan belt system includes a fan belt having a tension. The fan belt extends about the drive pulley and the driven pulley. The fan belt system also includes a rotatable take-up pulley. The take-up pulley is movable in order to adjust the tension of the fan belt to a user desired level.

The fan is oriented to pull air through the radiator from the first side to the second side thereof in response to rotation of the fan in a first direction. A housing element is positioned on the second side of the radiator. The housing element directs the air pulled through the radiator by the fan towards the fan clutch. The fan clutch includes a bi-metallic element for sensing the temperature of the air directed towards the fan clutch by the housing element.

In accordance with a further aspect of the present invention, a device is provided for cooling engine coolant flowing through a radiator of an engine-driven, electrical generator set. The engine has a crankshaft rotatable about a first axis and the radiator has a first side directed towards the engine and a second side. The device includes a fan positionable on the second side of the radiator. The fan is rotatable about a second axis generally parallel to the first axis. A thermally responsive clutch having a driven portion is also provided. The clutch is movable between a first disengaged position wherein the driven portion is isolated from the crankshaft and a second engaged position wherein the driven portion rotates in unison with the crankshaft in response to a predetermined temperature. A fan drive system interconnects and translates rotation of the driven portion of the clutch to the fan.

The fan drive system includes a driven pulley operatively connected to the fan for rotational movement therewith. In addition, the fan drive system includes a rotatable drive pulley and a fan belt. The rotatable drive pulley is operatively connected to the driven portion of the clutch for rotational movement therewith. The fan belt extends about the drive pulley and the driven pulley to translate rotation of the drive pulley to the driven pulley. A rotatable take-up pulley is provided to adjust the tension of the fan belt to a user-desired level.

It is contemplated for the fan to be orientated to pull air through the radiator from the first side to the second side of the radiator in response to rotation of the fan in a first direction. A housing element is positioned on the second side of the radiator to direct the air pulled through the radiator by the fan towards the clutch. The clutch includes a temperature sensing element for sensing the temperature of the air directed towards the clutch by the housing element.

In accordance with a still further aspect of the present invention, a method is provided for cooling engine coolant flowing through a radiator of an engine-driven, electrical generator set. The engine has a crankshaft rotatable about a first axis and the radiator has a first side directed towards the engine and a second side. The method includes the steps of positioning the fan on the second side of the radiator and monitoring the temperature on the second side of the radiator. The fan is rotatable about a second axis generally parallel to the first axis for drawing air through the radiator. The fan is operatively connected to the crankshaft in response to the temperature of the air on the second side of the radiator exceeding a threshold.

The fan is supported on a rotatable shaft having a driven pulley attached thereto. The driven pulley includes a groove formed therein. A drive pulley is also provided having a groove formed therein. A fan belt is positioned about the groove in the drive pulley and the groove in the driven pulley such that rotation of the drive pulley is translated to the driven pulley by the fan belt. The drive pulley is interconnected to a thermally responsive clutch. The clutch is movable between a first disengagement position wherein the drive pulley is isolated from the crankshaft and a second engaged position wherein the clutch translates rotation of the crankshaft to the drive pulley in response to the predetermined temperature. It is contemplated to disconnect the fan from the crankshaft in response to the temperature of the air on the second side of the radiator dropping below the threshold.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
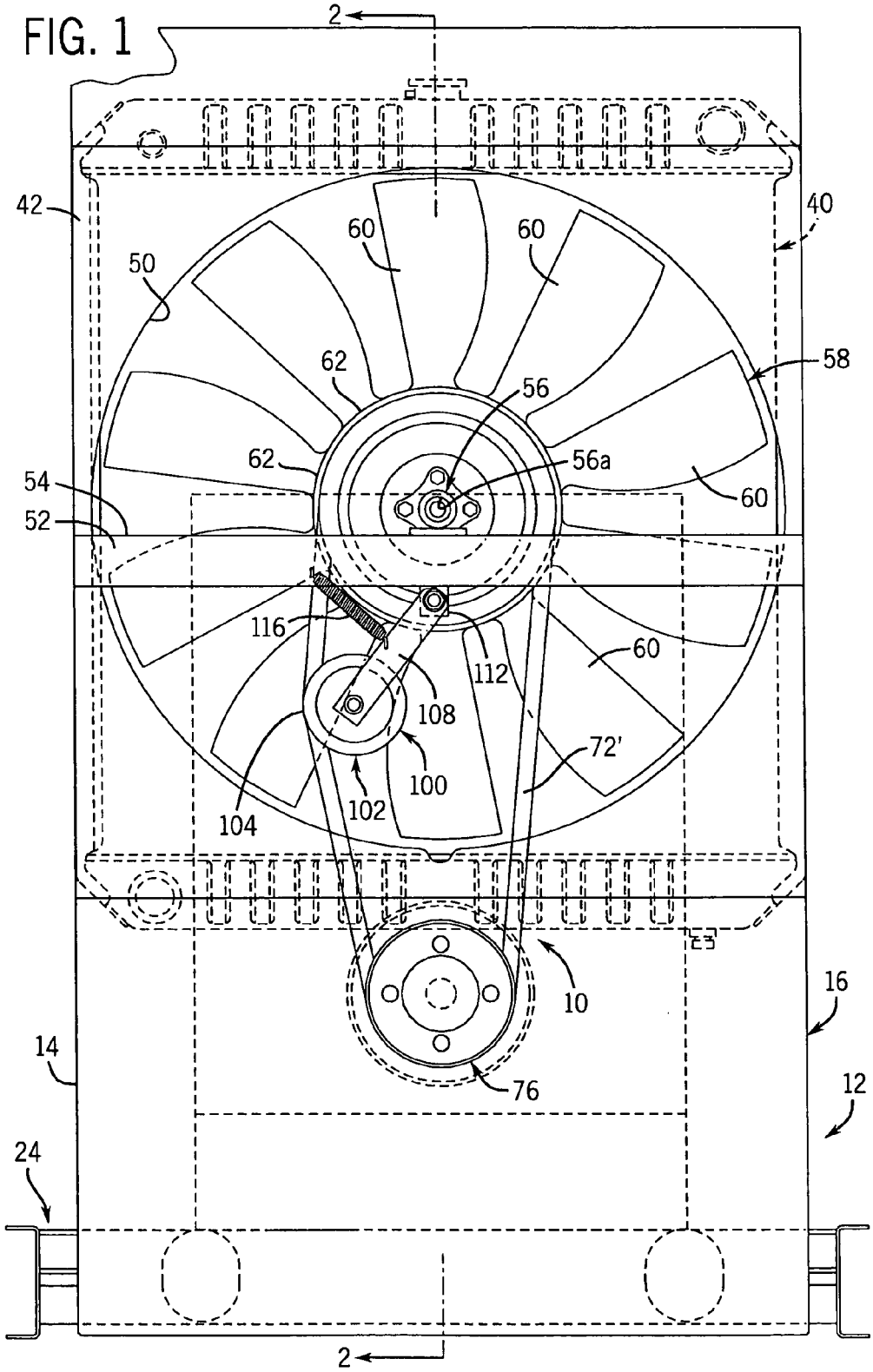
FIG. 1 is an end view of a fan drive system for an engine-driven, electrical generator set in accordance with the present invention.
Figure 2:
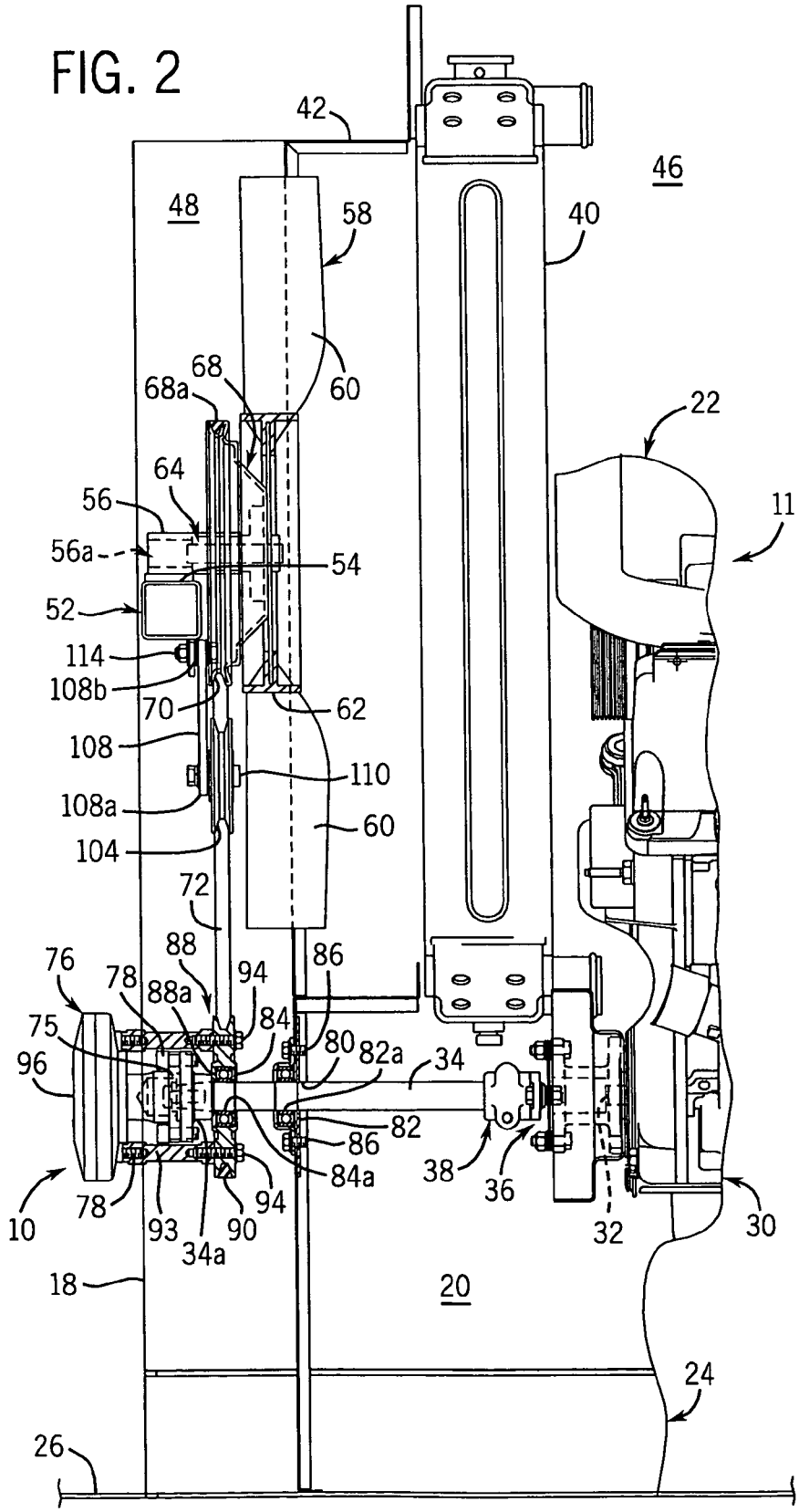
FIG. 2 is a cross-sectional view of the fan drive system of the present invention taken along line 2—2 of FIG. 1.

Referring to FIGS. 1 and 2, a fan drive assembly in accordance with the present invention is generally designated by the reference numeral 10. It is intended for fan drive assembly 10 to be used in connection with engine-driven, electrical generator set 11. As is conventional, generator set 11 is housed in enclosure 12 defined by first and second sidewalls 14 and 16, respectively, interconnected by a first forward end wall (not pictured) and a second rear end wall 18. Sidewalls 14 and 16 define interior 20 of enclosure 12. Base 24 of enclosure 12 is provided for supporting generator set 11 above a supporting surface 26 such as the ground, concrete slab or a mounting pad.

Generator set 11 includes an engine, generally designated by the reference numeral 30, which is supported within interior 20 of enclosure 12. As is conventional, engine 30 receives fuel such as diesel, natural gas or liquid propane vapor through an intake. The fuel is compressed and ignited within the cylinders of engine 30 so as to generate reciprocating motion of the pistons of engine 30. This reciprocating motion of the pistons of engine 30 is converted to rotary motion such that engine 30 rotates a drive or crankshaft 32 about a first horizontal axis. Crankshaft 32 of engine 30 is coupled to fan shaft 34 through flexible coupling hub 36 and flex plate 38.

Engine 30 is operatively connected to radiator 40 such that coolant from engine 30 circulates through radiator 40 during operation of engine 30. As is conventional, radiator 40 includes a plurality of radiator tubes (not shown) through which engine coolant flows. As hereinafter described, it is intended for air within interior 20 of enclosure 12 pass over the plurality of radiator tubes of radiator 40 so as to effectuate a heat exchange between the engine coolant flowing through the plurality of radiator tubes of radiator 40 and the air within interior 20 of enclosure 12 in order to cool the engine coolant.

Radiator 40 is supported within interior 20 of enclosure 12 by radiator support 42. Radiator support 42 acts as a partition to separate interior 20 of enclosure 12 into a first engine receiving portion 46 for receiving engine 30 and radiator 40 therein and a second clutch receiving portion 48. Radiator support 42 further includes generally circular fan opening 50 therethrough for allowing communication between first portion 46 and second portion 48 of interior 20 of enclosure 12. Generally horizontal support 52 bisects fan opening 50 and includes generally flat upper surface 54. Fan support tube 56 is mounted to upper surface 54 and includes passageway **56*a*** extending therethrough along a second generally horizontal axis, axially spaced from and generally parallel to the first horizontal axis, for reasons hereafter described.

In order to draw air over the plurality of radiator tubes of radiator 40, fan 58 is provided in opening 50 through radiator support 42. Fan 58 includes a plurality of fan blades 60 extending radially from central hub 62. Central hub 62 is operatively connected to fan shaft 64 which is rotatably supported within passageway **56*a* of fan support 56. Fan pulley 68 is captured between fan shaft 64 and central hub 62 of fan 58 for rotational movement therewith. Fan pulley 68 includes a radially outer edge 68*a* having generally V-shaped groove 70 formed therein that is adapted for receiving fan belt 72**, as hereinafter described.

As best seen in FIG. 2, fan shaft 34 includes terminal end **34*a* interconnected to drive portion 75 of thermally responsive fan clutch 76 by bolts 78. Jackshaft 34 extends through opening 80 in radiator support 42; through central opening 82***a* in bearing 82 and through central opening 84*a* in bearing 84. Bearing 82 is interconnected to radiator support 42 by a plurality of bolts 86 such that central opening 82*a* therethrough is axially aligned with opening 80 through radiator support 42. Bearing 84 is received within central opening 88*a* of drive pulley 88.

Drive pulley 88 includes V-shaped groove 90 in outer periphery thereof adapted for receiving fan belt 72. Drive pulley 88 is interconnected to driven portion 93 of fan clutch 76 by a plurality of bolts 94. Fan clutch 76 is preferably a viscous fan drive that includes a bimetallic temperature sensing element 96. Temperature sensing element 96 causes fan clutch 76 to operate in a disengaged position wherein drive portion 75 and driven portion 93 of fan clutch 76 are isolated from each other when the ambient air temperature sensed is below a predetermined temperature and to operate in an engaged position wherein rotation of drive portion 75 of fan clutch 76 is translated to driven portion 93 of fan clutch 76 when the ambient air temperature sensed above a predetermined temperature. More specifically, in its engaged position, fan clutch 76 operatively connects drive portion 75 of fan clutch 76 to driven portion 93 such that rotation of fan shaft 34 by crankshaft 32 of engine 30 is translated to drive pulley 88 which, in turn, rotates fan pulley 68 through fan belt 72. Fan pulley 68, in turn, rotates fan 58 about the second horizontal axis extending through passageway 56*a* of fan support tube 56. It can appreciated that in its engaged position, fan clutch 76 may be fully or partially engaged. With fan clutch 76 in its fully engaged position, rotation of crankshaft 32 is translated to drive pulley 88 through jackshaft 34 and fan clutch 76. In its partially engaged condition, clutch 76 allows driven portion 93 of fan clutch 76 to slip with respect to drive portion 75 of fan clutch 76 such that drive pulley 88 rotates at a speed less than the speed of rotation of crankshaft 32. As such, it can be understood that fan clutch 76 causes drive pulley 88 to rotate a variable speed dependent upon the ambient temperature sensed by temperature sensing element 96. With fan clutch 76 in its disengaged position, jackshaft 34 rotates independently of drive pulley 88.

It is contemplated to vary the diameters of drive pulley 88 and fan pulley 68 to vary the rotational speed of fan 58 for a given, constant rotational speed of crankshaft 32 of engine 30. More specifically, by reducing the diameter of fan pulley 68 with respect to the diameter of drive pulley 88, the rotational speed of fan 58 can be increased with respect to the rotational speed of crankshaft 32. Alternatively, if the diameter of fan pulley 68 is larger than the diameter of drive pulley 88, the rotational speed of fan 58 can be decreased with respect to the rotational speed of crankshaft 32. Finally, if the diameter of fan pulley 68 is identical to the diameter of drive pulley 88, the rotational speed of fan 58 will be identical to the rotational speed of crankshaft 32. As a result, fan drive assembly 10 allows for the use of a smaller rated clutch and still provide adequate rotational fan speed to cool the engine coolant flowing through radiator 40.

In order to maintain the tension on fan belt 72, take-up pulley assembly, generally designated by the reference numeral 100, is provided. Take-up pulley assembly 100 includes take-up pulley 102 having V-shaped groove 104 in the outer periphery thereof. V-shaped groove 104 is adapted for receiving fan belt 72. The hub of take-up pulley 102 is rotatably connected to first end 108*a* of tension arm 108 by nut and bolt combination 110. Second end 108*b* of tension arm 108 is pivotably connected to flange 112 depending from support 52 by nut and bolt combination 114. A tension spring 116 interconnects tension arm 108 to support 52 so as to urge take-up pulley 102 towards support 52 in a clockwise direction. The tension of spring 116 corresponds to the tension placed on fan belt 72 by take-up pulley 102.

In operation, generator set 11 is activated so as to start engine 30. As is conventional, engine 30 drives an alternator (not shown) which, in turn, generates electricity. Once started, engine 30 rotates crankshaft 32, and hence, fan shaft 34 about the first horizontal axis. With fan clutch 76 in its disengaged position, drive portion 75 of fan clutch 76 rotates independently of driven portion 93 of fan clutch 76. When the temperature sensed by temperature sensing element 96 exceeds a predetermined threshold, fan clutch 76 moves to its engaged position wherein fan clutch 76 either partially or fully interconnects drive portion 75 of fan clutch 76 to driven portion 93 of fan clutch 76 such that rotation of drive portion 75 is translated either, partially or fully, to driven portion 93 of fan clutch 76, as heretofore described.

With fan clutch 76 in its engaged position, the rotation of jackshaft 34 by crankshaft 32 of engine 30 is translated to drive pulley 88 interconnected to driven portion 93 of fan clutch 76 which, in turn, rotates fan pulley 68 through fan belt 72. Fan pulley 68, in turn, rotates fan 58 about the second horizontal axis in the first direction so as to draw air through radiator 40. It can be appreciated that the air drawn through radiator 40 effectuates a heat exchange with the engine coolant flowing through the plurality of radiator tubes of radiator 40. In addition, fan 58 draws air from first portion 46 of interior 20 of enclosure 12 and urges such air into second portion 48 of interior 20 of enclosure 12. Rear end wall 18 of enclosure 12 directs the air urged into second portion 48 of interior 20 of enclosure 12 downwardly within second portion 48 of interior 20 of enclosure 12 toward fan clutch 76. When the temperature sensed by temperature sensing element 96 drops below a predetermined threshold temperature, fan clutch 76 moves to its disengaged position, as heretofore described. In its disengaged position, fan 58 is isolated from crankshaft 32. As engine 30 continues to operate, the process is repeated whereby temperature sensing element 96 moves fan clutch 76 between its disengaged and engaged positions in response to the temperature sensed by temperature sensing element 96.

Various modes of carrying out the invention are contemplated as being within the scope of the following claims particularly pointing and distinctly claiming the subject matter which is regarded as the invention.

We claim:

1. A fan assembly connectable to a crankshaft of an engine for facilitating the cooling of engine coolant flowing through a radiator, the radiator having a first side directed toward the engine and a second side, the fan assembly comprising:

a rotatable fan positionable on the second side of the radiator;

a driven pulley operatively connected to the fan for rotational movement therewith;

a rotatable drive pulley;

a fan belt system extending about the drive pulley and the driven pulley, the fan belt system translating rotation of the drive pulley to the fan; and a fan clutch movable between a first disengaged position wherein the drive pulley is isolated from the crankshaft and a second engaged position wherein the fan clutch translates rotation of the crankshaft to the drive pulley in response to a predetermined temperature.

2. The fan assembly of claim 1 wherein the fan belt system includes a fan belt having a tension, the fan belt extending about the drive pulley and the driven pulley.

3. The fan assembly of claim 2 wherein the fan belt system includes a rotatable take-up pulley, the take-up pulley being movable to adjust the tension of the fan belt to a user-desired level.

4. The fan assembly of claim 1 wherein the fan is orientated to pull air through the radiator from the first side to the second side of the radiator in response to rotation of the fan in a first direction.

5. The fan assembly of claim 4 further comprising a housing element positioned on the second side of the radiator, the housing element directing the air pulled through the radiator by the fan towards the fan clutch.

6. The fan assembly of claim 5 wherein the fan clutch includes a bimetallic element for sensing the temperature of the air directed towards the fan clutch by the housing element.

7. A device for cooling engine coolant flowing through a radiator of an engine-driven, electrical generator set, the engine having a crankshaft rotatable about a first axis and the radiator having a first side directed towards the engine and a second side, the device comprising:

a fan positionable on the second side of the radiator and rotatable about a second axis, generally parallel to the first axis;

a thermally responsive clutch having a driven portion, the clutch movable between a first disengaged position wherein the driven portion is isolated from the crankshaft and a second engaged position wherein the driven portion rotates in unison with the crankshaft in response to a predetermined temperature; and a fan drive system interconnecting the hub of the clutch and the fan, the fan drive system translating rotation of the hub to the fan.

8. The device of claim 7 wherein the fan drive system includes:

a driven pulley operatively connected to the fan for rotational movement therewith;

a rotatable drive pulley operatively connected to the driven portion of the clutch for rotational movement therewith; and a fan belt extending about the drive pulley and the driven pulley, the fan belt translating rotation of the drive pulley to the driven pulley.

9. The device of claim 8 wherein the fan belt system includes a rotatable take-up pulley and wherein the fan belt has a tension, the take-up pulley being movable to adjust the tension of the fan belt to a user-desired level.

10. The device of claim 7 wherein the fan is orientated to pull air through the radiator from the first side to the second side of the radiator in response to rotation of the fan in a first direction.

11. The device of claim 10 further comprising a housing element positioned on the second side of the radiator, the housing element directing the air pulled through the radiator by the fan towards the clutch.

12. The device of claim 11 wherein the clutch includes a temperature sensing element for sensing the temperature of the air directed towards the clutch by the housing element.

13. A method of cooling engine coolant flowing through a radiator of an engine-driven, electrical generator set, the engine having a crankshaft rotatable about a first axis and the radiator having a first side directed towards the engine and a second side, the method comprising the steps of:

positioning a fan on the second side of the radiator, the fan being rotatable about a second axis generally parallel to the first axis;

monitoring the temperature of the air on the second side of the radiator; and operatively connecting the fan to the crankshaft in response to the temperature of the air on the second side of the radiator exceeding a threshold.

14. The method of claim 13 further comprising the additional steps of:

supporting the fan on a rotatable fan shaft having a driven fan pulley attached thereto, the driven fan pulley including a groove formed therein;

providing a drive pulley having a groove formed therein; and positioning a fan belt about the groove of the driven fan pulley and the groove of the drive pulley such that rotation of the drive pulley is translated to the driven fan pulley by the fan belt.

15. The method of claim 14 comprising the additional step of interconnecting the drive pulley to a thermally responsive clutch, the clutch movable between a first disengaged position wherein the drive pulley is isolated from the crankshaft and a second engaged position wherein the clutch translates rotation of the crankshaft to the drive pulley in response to a predetermined temperature.

16. The method of claim 15 comprising the additional steps of:

drawing air through the radiator with the fan; and directing the air drawn through the radiator towards the clutch.

17. The method of claim 13 comprising the additional step of disconnecting the fan from the crankshaft in response to the temperature of the air on the second side of the radiator dropping below the threshold.

* * * * *